US008444345B2

(12) United States Patent
Welch

(10) Patent No.: US 8,444,345 B2
(45) Date of Patent: May 21, 2013

(54) FLOATATION COLLAR FOR PROTECTING AND POSITIONING A SENSOR PACKAGE

(76) Inventor: David Welch, Nanaimo (CA)

( * ) Notice: Subject to any disclaimer, the term of this patent is extended or adjusted under 35 U.S.C. 154(b) by 641 days.

(21) Appl. No.: 12/642,391

(22) Filed: Dec. 18, 2009

(65) Prior Publication Data

US 2010/0282157 A1 Nov. 11, 2010

Related U.S. Application Data

(60) Provisional application No. 61/176,095, filed on May 6, 2009.

(51) Int. Cl.
*B63B 22/24* (2006.01)
*F16L 1/24* (2006.01)

(52) U.S. Cl.
USPC ..... 405/171; 405/211; 114/32

(58) Field of Classification Search
USPC ..... 405/195.1, 211, 171; 114/267; 441/1, 441/32, 33
See application file for complete search history.

(56) References Cited

U.S. PATENT DOCUMENTS

| | | | | |
|---|---|---|---|---|
| 2,518,981 | A * | 8/1950 | Edwards | 138/178 |
| 3,436,775 | A * | 4/1969 | Seeley et al. | 441/33 |
| 5,218,366 | A * | 6/1993 | Cardamone et al. | 342/385 |
| 7,121,767 | B1 * | 10/2006 | Watkins | 405/216 |
| 7,744,314 | B2 * | 6/2010 | Eide | 405/224.2 |
| 2002/0003039 | A1 * | 1/2002 | Wells | 166/350 |
| 2009/0036008 | A1 * | 2/2009 | Watkins et al. | 441/1 |

* cited by examiner

*Primary Examiner* — Tara M. Pinnock
(74) *Attorney, Agent, or Firm* — Gordon Thomson

(57) ABSTRACT

A floatation collar for a sensor package forming part of a detection array comprises two halves that when joined together act as a protective casing that secures and orients a sensor package in an optimal configuration within a water column. The collar comprises a shell tilled with syntactic foam. The cellar top portion includes a series of projections strategically placed to protecting the sensor package transducers against mechanical damage. The base bottom portion of the collar is conical with an integral thimble to allow the collar to ride down and then emerge under a passing trawl net or other fishing lines or cables by presenting a smooth aspect and a secure means of tethering said unit to a bottom anchor.

5 Claims, 10 Drawing Sheets

A

TOP VIEW

PROFILE VIEW

B

FIG 10—IMPROVEMENT IN PERFORMANCE
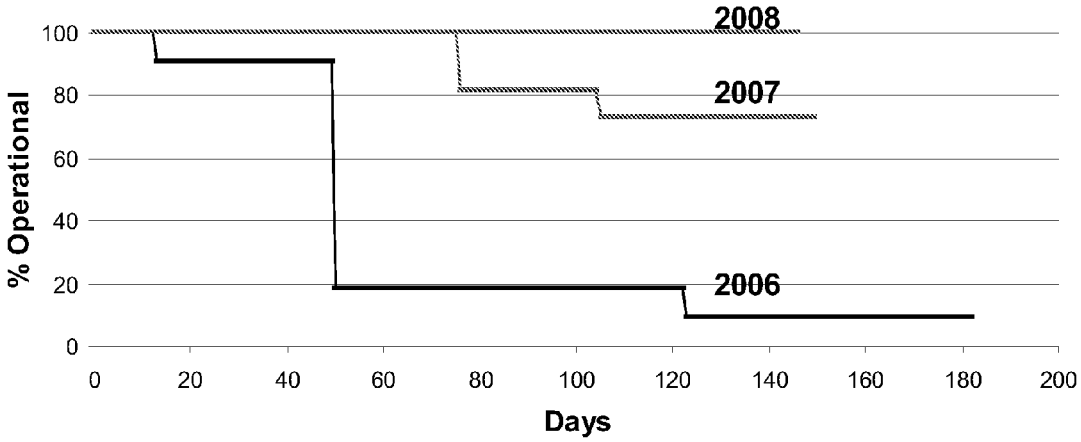

FLOATATION COLLAR FOR PROTECTING AND POSITIONING A SENSOR PACKAGE

CROSS-REFERENCE TO RELATED APPLICATIONS

This application claims the benefit of U.S. Provisional Patent Application No. 61/176.095 filed on May 9, 2009.

BACKGROUND

1. Field of the Invention

This invention is related to buoys, rafts and aquatic devices and more particularly to a floatation collar for an undersea acoustic receiver and method of positioning a plurality of the same in the presence of fishing, gear or other activities that would potentially disrupt the sensor positioning within the water column.

2. Description of the Prior Art

Acoustic receivers are used in many underwater applications such as identification of sub-surface vessels, marine mammals and fish. These receivers are expensive and sensitive electronic devices and can be rendered inoperative if exposed transducers are damaged. The challenges in placing these devices in an underwater environment relate to (1) protection the device from commercial fishing gear (such as trawls or long-lines) in such a way that its operation is not impeded, (2) deployment of the device occurs in a fast and cost-efficient manner while at sea, and (3) recovery of the device for repair and re-use is Meditated.

Typically, an acoustic receiver is encased in buoy-like objects that protect the device and enables recovery. The receiver is generally tethered to either a surface float or sub-surface floats located above the receiver that help maintain the acoustic receiver at a desirable predetermined depth. For many purposes, the depth that the receiver must be positioned in the water column is critical because, for example in the field of animal telemetry, acoustic transmitters ("tags") small enough to be surgically implanted into small fish have low power transmissions in order to conserve the battery. As a result, in locations where the water depth is near to or exceeds the transmission range of the signal, the receivers must be placed in mid-water in order to satisfactorily detect the signals emitted from tagged animals that might be located near either the bottom or the surface. In areas of rough bottom terrain, the receivers also need to be lifted well above the bottom in order to "see" downwards over a wide area. Placing the receivers at or near the sea surface is not feasible because storms and biofouling sharply degrade the operational life of equipment, necessitating their sub-surface placement at depths deep enough to be little affected by storms or biological fouling (which is largely light-dependent). In the case of acoustic telemetry receivers, placing sub-surface floats above the receiver creates a shadow and occludes part of the area that is of interest to monitor, as well as increasing the chance of the system will become fouled and displaced by fishing activities (trawlers or groundlines). For many purposes, degradation of arrays of receivers due to either physical loss or displacement of units or impairment of their detection capability results in substantial economic costs to compensate for reduced performance.

One such object 10 that can address these needs is shown as FIG. 1 and is labelled prior art. The casing 12 is somewhat barrel-shaped and has a number of disadvantages. The circular shape of the barrel is not stable when placed on the boat deck, and the square bottom profile presents a potential point where commercial fishing gear can snag at the junction of the casing and the mooring tether. This may result in the buoy being snagged by fishing gear and lost or moved out of position in an array of geographically positioned sensors. The top projections of the barrel 14 are not sufficiently long to protect the sensitive emitters and detectors on the acoustic device 16 and so they remain prone to mechanical damage. The tether mechanism 18 connecting the buoy 10 to an anchor is metallic and prone to corrosion and mechanical wear by wave action. This may sever the tether 24 which may result in loss of both the weight and the acoustic device.

Therefore, there is a requirement for a positioning system that overcomes the deficiencies noted above.

SUMMARY

With recent developments in low-cost and long-lived battery operated acoustic telemetry systems, a critical need exists for an ability to position a multiplicity of independent sensors in very long-term (5-10 year) deployments at any chosen depth in the water column to form a seamless detection array. The sensors so positioned must be protected and maintain their relative position within the array for up to a decade from damage or degradation from impacts from fishing activity, corrosion, bio-fouling or weather related effects.

In accordance with the present invention there is provided a novel design for a floatation collar for an undersea acoustic receiver that overcomes the deficiencies noted above. The floatation collar is a two-piece system that is adapted to encase the acoustic receiver or other sensor package. Each of the pieces is moulded from polyethylene to form a shell that is filled with syntactic foam and air filled pressure resistant spheres to provide buoyancy and increased detection by sonar (to enhance recovery when required). The floatation collar is shaped in such a way as to provide a clear field of view around the instrument's sensors, and to not block signal detection except in orientations where the air-filled body of the acoustic receiver already blocks the signal path (directly below the sensor's transducer). The top portion of the collar includes a plurality of projections adapted to protect the exposed elements of the sensor package such as the transmitting and receiving transducers against such things as trawler nets, cables, ground lines for bottom laid fishing gear, while ensuring minimal occlusion of the sensors. The bottom portion of the collar includes an integral tether connection that is moulded into the two-piece collar and is designed to minimize mechanical stress on the tethers so as to prevent breakage by an internally formed "thimble" with an engineered radius designed so as to not compromise the natural breaking strength of the tether. The connection is non-metallic and so is not prone to corrosion, which in long-term marine applications is severe unless titanium is used. The upper portion of the floatation collar of the present invention comprises a plurality of flat bevelled inward sloping surfaces to prevent occlusion of the sensors, provide a reflective surface to make it visible to surface and underwater sonar devices operating above and below the collar, and ensure that the units remain stable on the dock of the boat during deployment operations and can be packed in close configuration, making efficient use of deck space. The tether, and anchor are made from synthetic materials that are resistant to bio-fouling. The present invention has the advantages of recoverability, non-corrosive material, re-usability, rapid deployablility, ability to position the sensor packages at any depth in the sea, and ability to reliably return to that position after being struck or run-over by commercial fishing trawls or other fishing gear.

A critical element of the current invention is the cone-shaped projection on the bottom of the positioning system and the smooth shape presented to a trawl net or ground line that contacts the equipment. The design is intended to allow the unit to prevent snagging by fishing gear that impacts on it, as sufficient anchoring weight on the seabed allows the unit to be pulled (first) downward to the trawl net that has impacted the tether and then (second) to flip the positioning system out of the trawl net because the cone shaped projection forms a "lever arm". This provides sufficient rotational three to flip and pull the receiver out of the impacting fishing gear, whereupon the trawl net or groundline passes over top of the unit, the projecting horns protect the transducers during net passage, and then after the fishing gear has passed the floatation within the unit raises the unit back up to its intended depth and position in the water column.

DRAWING FIGURES

Figure 8:
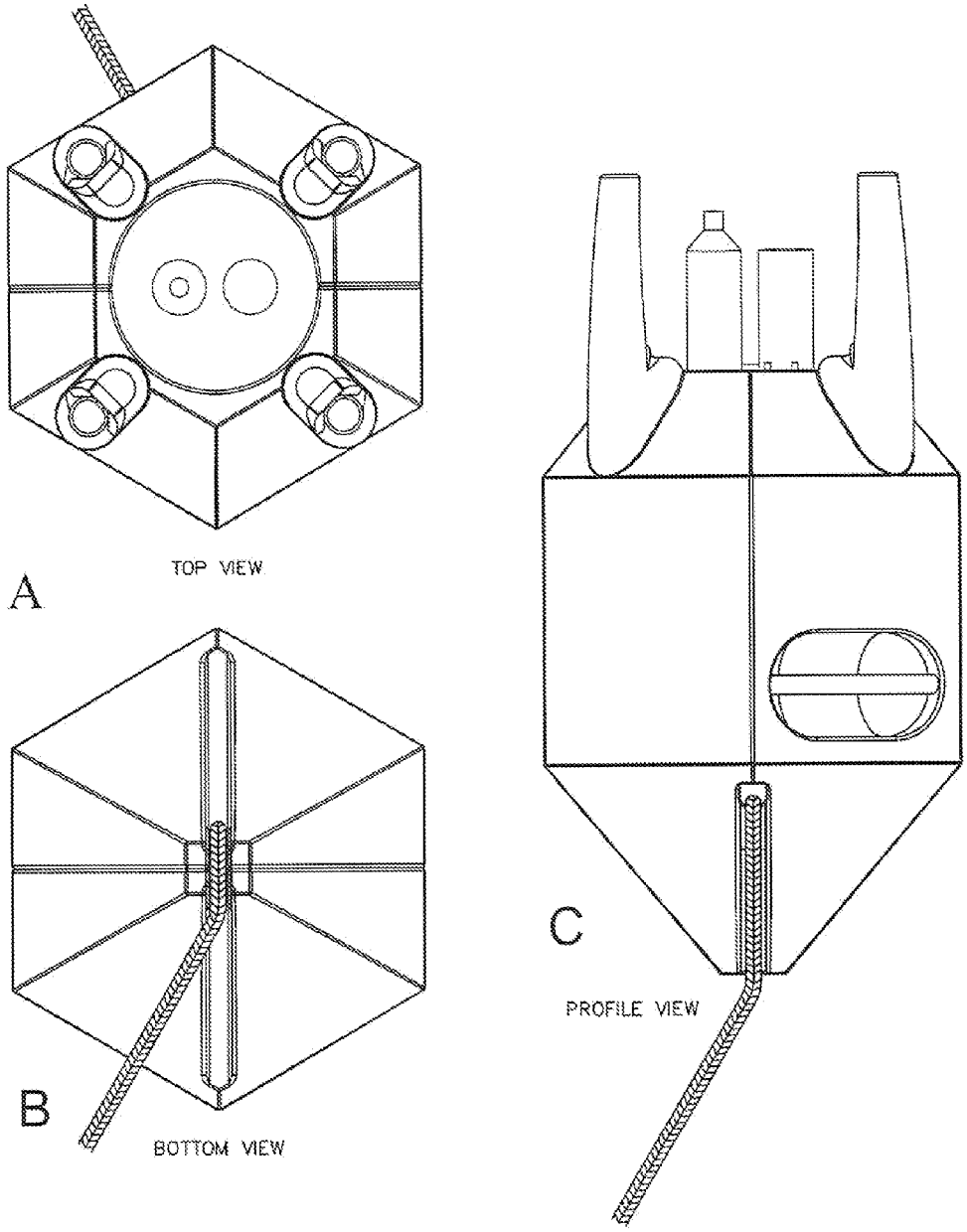

FIG. 8 comprises three views of the invention with tether attached, wherein FIG. 8A is a top view thereof, FIG. 8B is a bottom view thereof and FIG. 8C is a profile view thereof.

Figure 9:
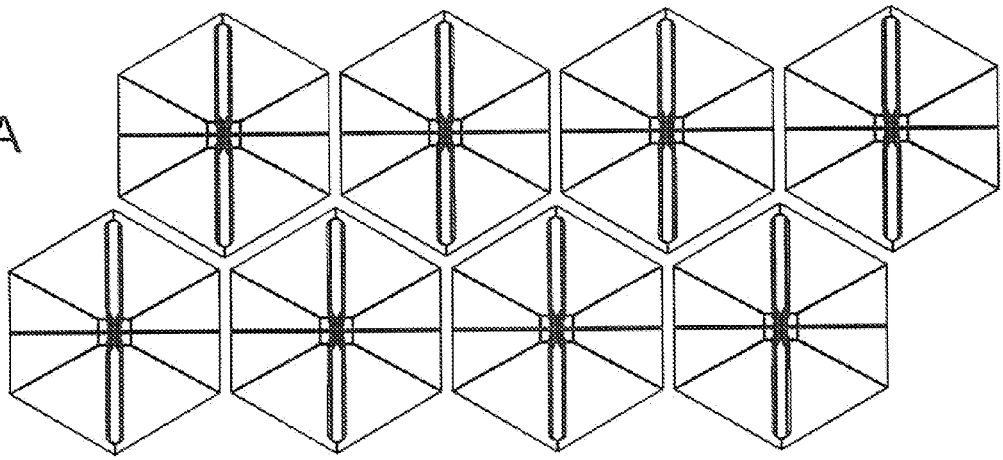
Figure 9:
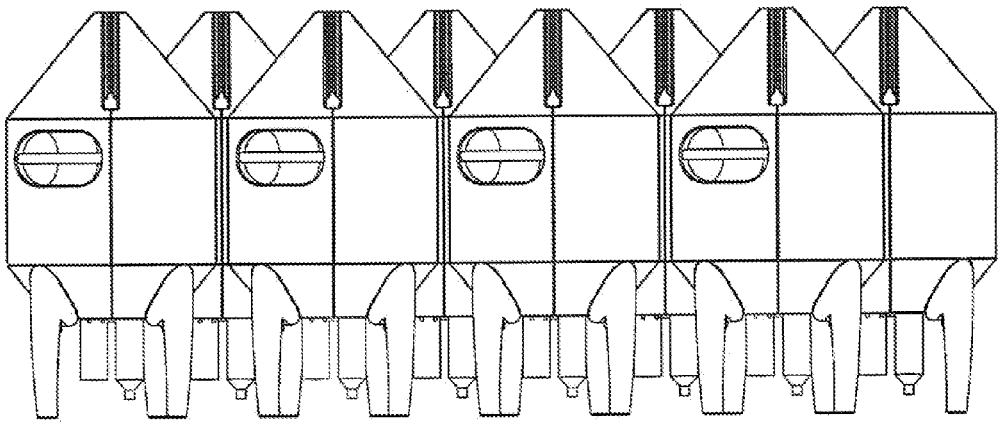

FIG. 9 is a view of several floatation collars stacked neatly on the deck of a vessel just prior to being secured against movement wherein FIG. 9A is a top view of the floatation collars and FIG. 9B is a profile view of the floatation collars.

FIG. 10 is a graph showing improved performance of the present invention in an area subjected to very heavy bottom trawling.

DESCRIPTION

Figure 1:
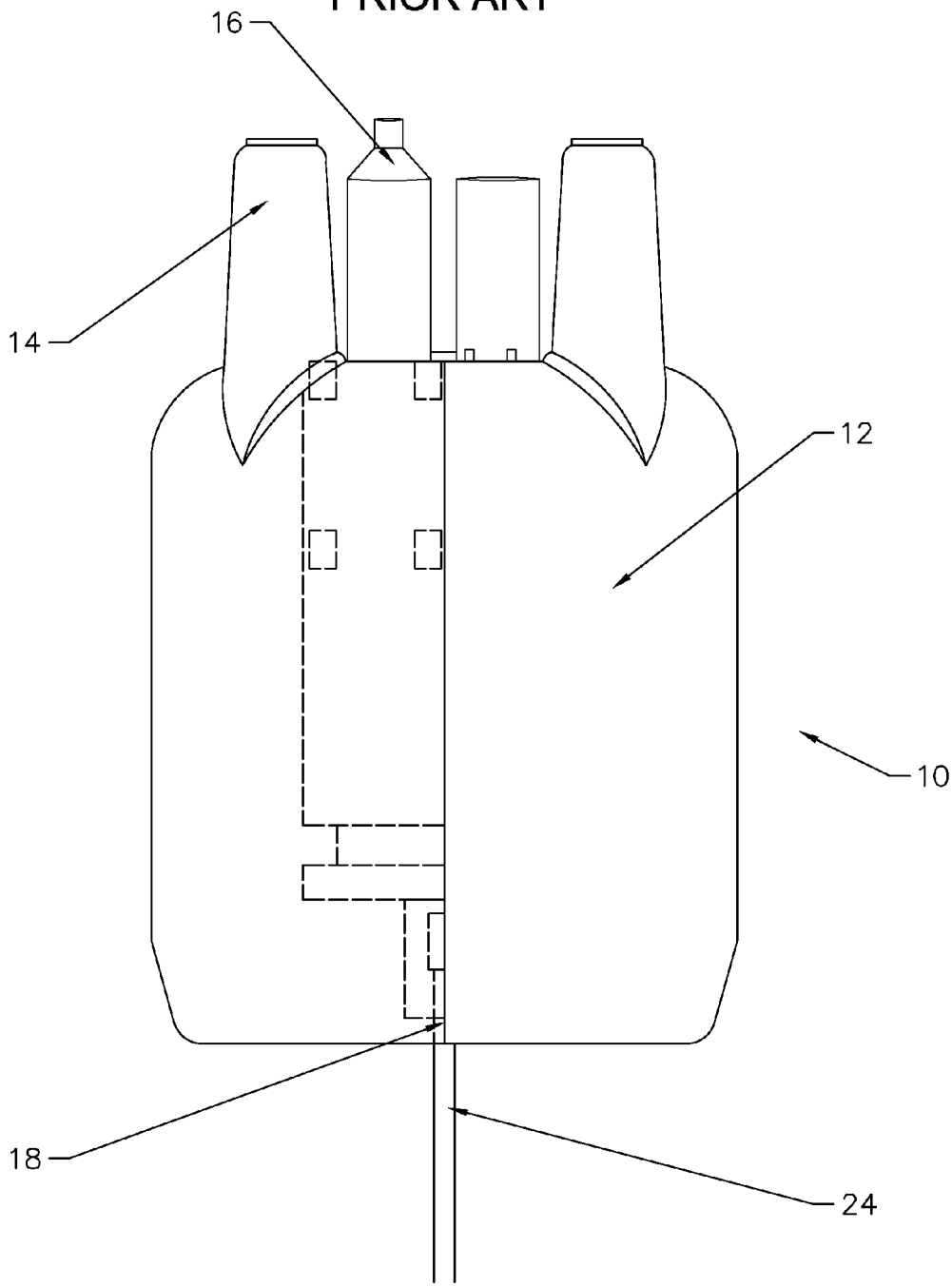
FIGURE 1 PRIOR ART
FIG. 1 is a side view of a prior art floatation collar or positioning system.
Figure 2:
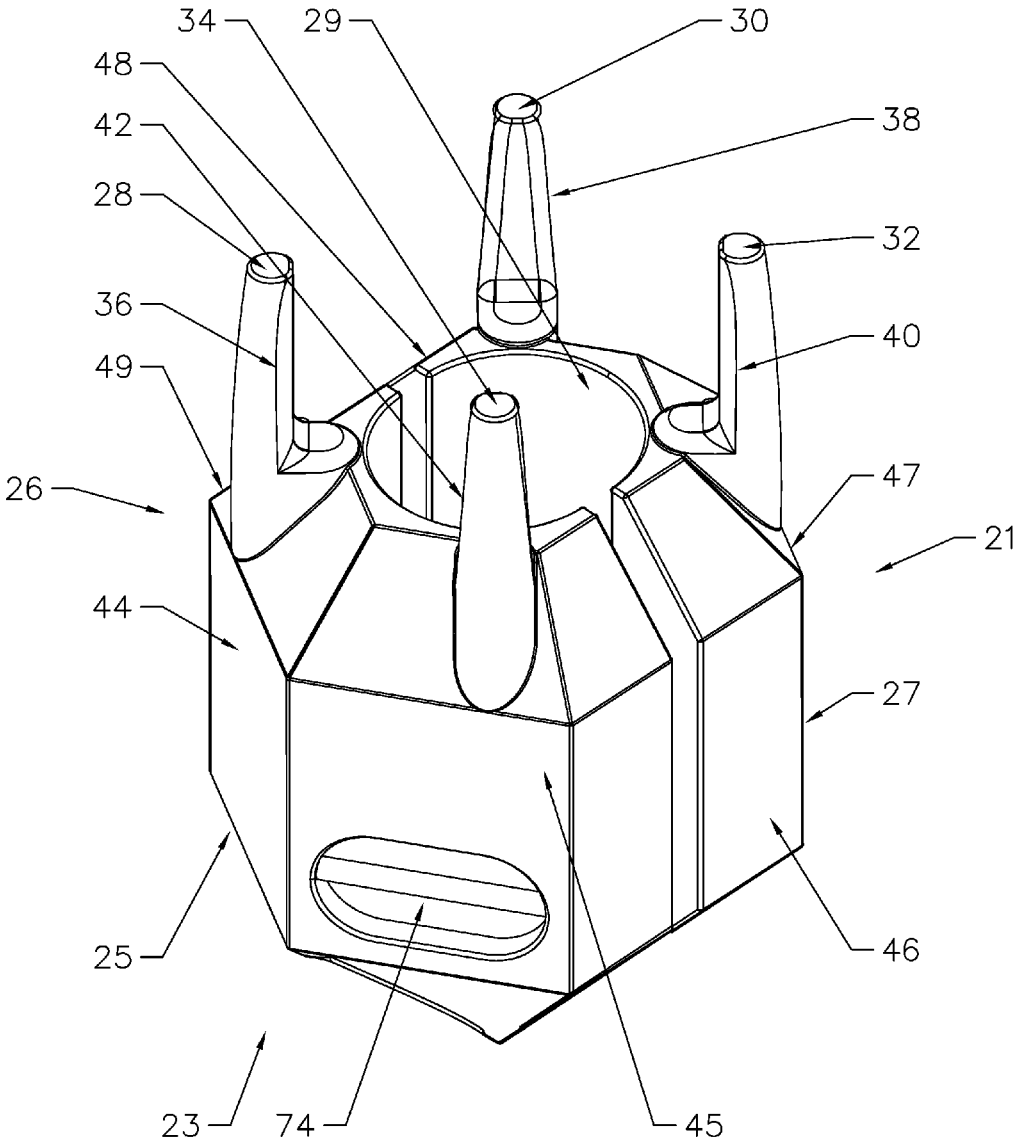
FIG. 2 is a perspective top view of one embodiment of the present invention.

Referring to FIG. 2, there is shown a side view of one embodiment the present invention 21. The invention is a casing 23 that comprises two-piece synthetic polymer shell 25 and 27 that are tilled with syntactic foam. The wall of the shell is thick enough to give the easing high strength, which is further reinforced by the syntactic foam filling, which provides rigid buoyancy at any depth (by appropriate specification of the syntactic foam formulation), and the rigid shell surrounds and secures in place a sensor package (not shown) placed between diem and into the receiving chamber 29 formed when the two pieces are joined. The shells are designed to resist bio-fouling by choosing a non-corroding synthetic, material for the shell such as polyethylene.

In this figure, the pieces of the shell are slightly off-set to illustrate that they are two independent pieces. The top portion 26 of the casing comprises a plurality of vertical projections or horns 28, 30, 32 and 34 that are sufficiently long to exceed the height of the sensors so as to protect them against mechanical damage by nets, cables or lines. However, their design is such that they do not interfere with the operation of the transducers of the sensor array to the minimum extent possible, and since they are filled with syntactic they are largely transparent to acoustic signals at the frequencies of general interest. Prior art metallic cages can be dispensed with.

Conveniently the vertical projections have curved indentations 36, 38, 40 and 42 in their inside surfaces to allow them to act as lifting handles for the casing and sensor array once assembled and minimize the chance of the unit being dropped during transport. The casing of the embodiment shown is hexagonal in shape to facilitate most efficient packing during transit but other symmetrical shapes could be used such as square or octagonal. The vertical sides of the casing 44, 45, 46, 47, 48 and 49 comprise about one-third the total height of the casing.

Figure 3:
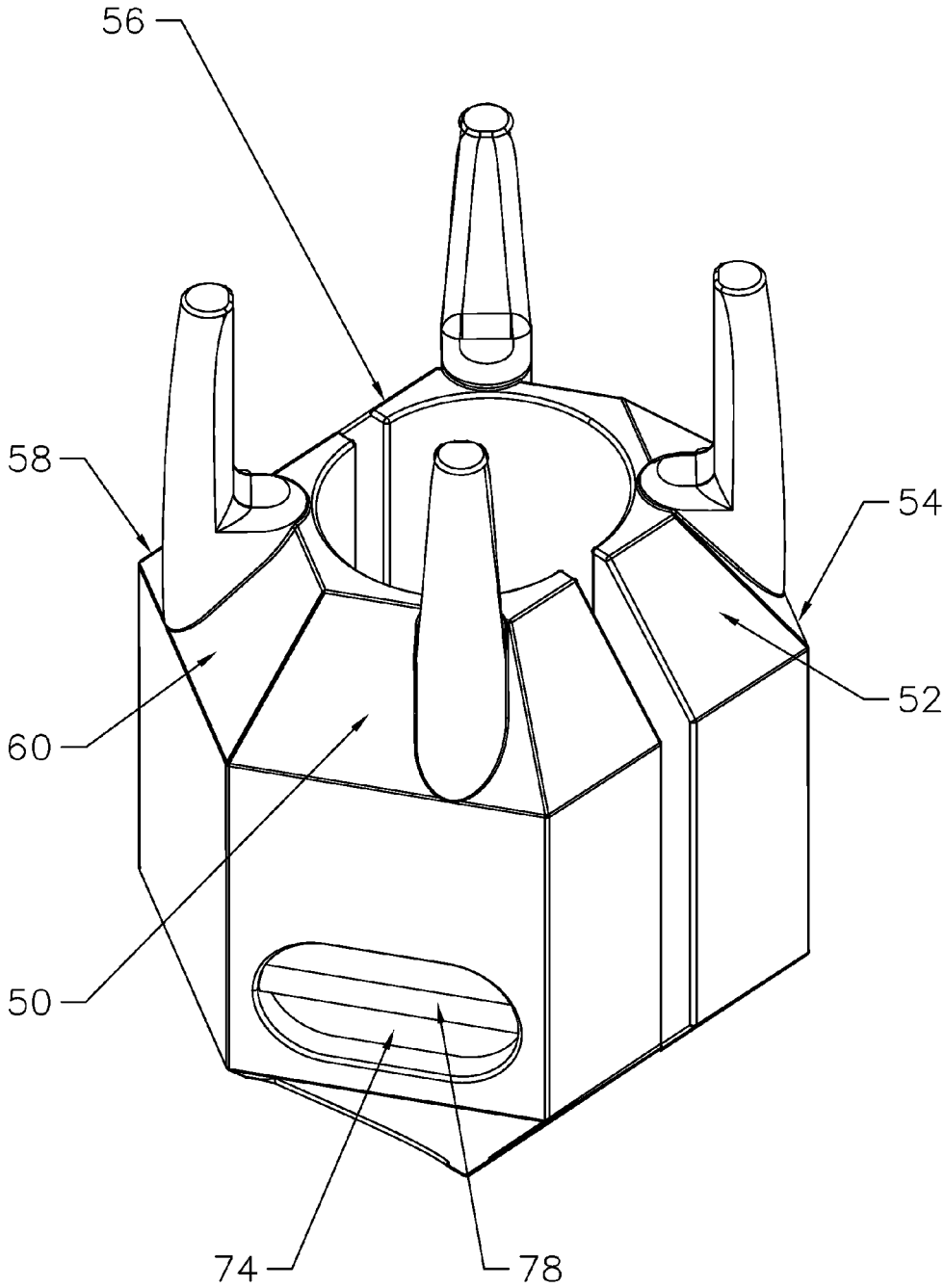
FIG. 3 is the same view as FIG. 2.

Referring to FIG. 3, which is the same view as FIG. 2, above each of the vertical sides is an inward-sloping side 50, 52, 54, 55, 58 and 60. These sides slope at an angle of about 45 degrees in order to provide additional reflective surfaces for sonar signals that might originate from a surface vessel searching for a non-operational unit that is not responding.

From four opposite sides project the aforementioned projections adapted to protect vulnerable portions of sensor array.

Figure 4:
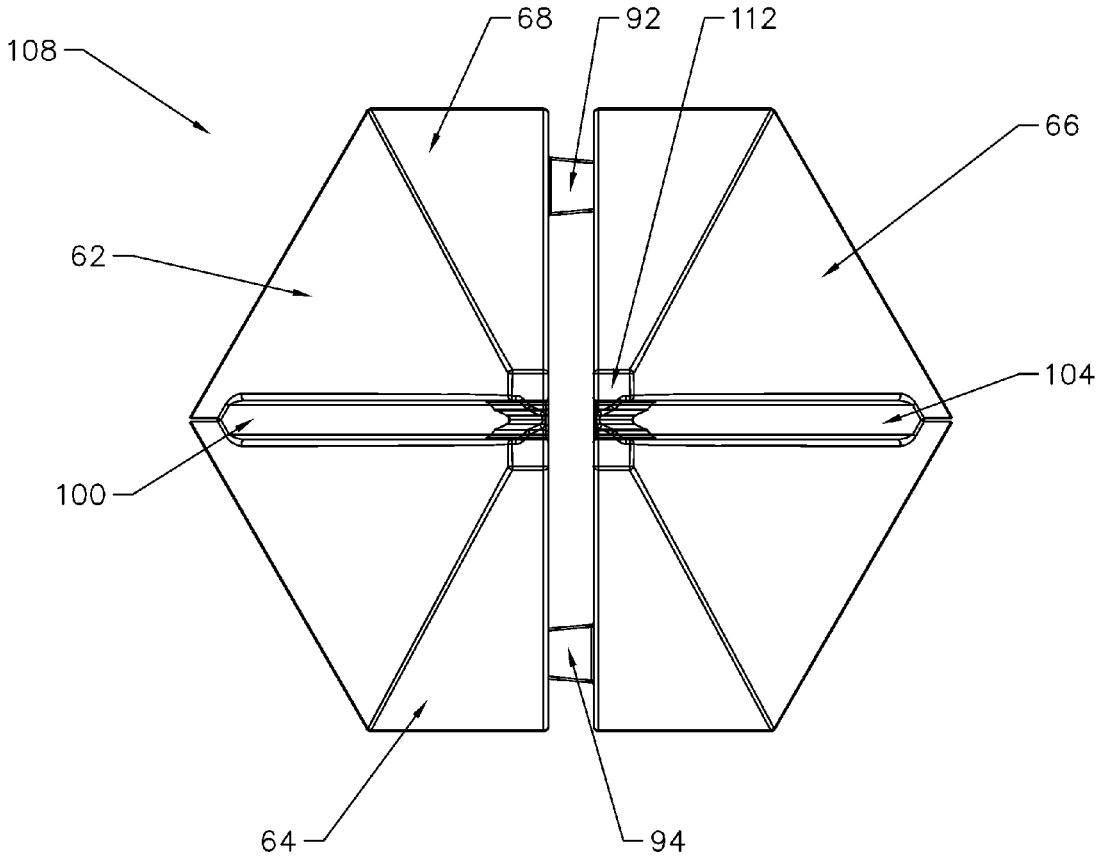
FIG. 4 is a bottom view of one embodiment of the present invention.

Referring to FIG. 4, which is a bottom view of the casing below the six vertical sides are four inward sloping slides 62, 64, 66 and 68. These sides are also designed to reflect sonar signals originating from an underwater sonar device such as one placed onboard an ROV located beneath the mid-water positioning system and searching for a non-responsive unit.

Figure 5:
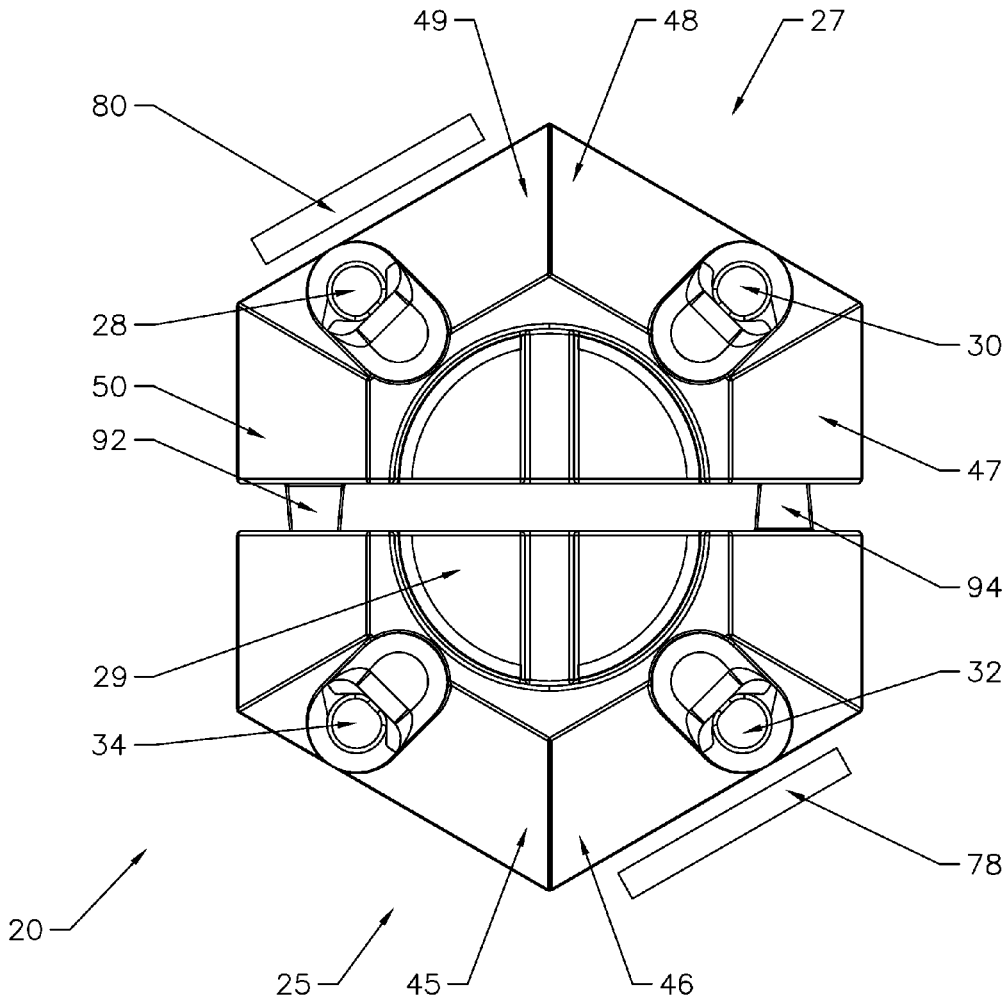
FIG. 5 is a top view of one embodiment of the present invention.

Referring back to FIG. 3, indentation 74 and its opposite indentation 76 with dowels 78 and 80 are adopted to form a carrying handle so that one person can handle the sensor package and floatation collar when cm deck or when being transported from truck to boat. By varying the formulation of the syntactic foam, the floatation collar can be designed to resist pressures to arbitrary depth, allowing the unit to be positioned at any depth beneath the water's surface. Referring to FIG. 5, there is shown a top view of the casing 20 comprising casing halves 25 and 27. Projections 28, 30, 32, and 34 project upwards from sides 45, 46, 48 and 49. Sides 47 and 50 are split between halves 25 and 27. In the middle of the two halves is formed a receptacle 29 for receiving and securing a sensor package. Dowels 78 and 80 are illustrated as carrying handles once inserted into indentations 74 and 76. Between the two halves 25 and 27 are two protruding tabs 92 and 94 which insert into matching sockets on the opposing half and fix the two halves together. The two halves are secured together either by dowels or screws suitably resistant to sea water; for example, in a preferred embodiment four SiAl-Bronze screws are used to hold the halves together by piercing, the protruding, tabs 92 and 94 after they have been mated into matching sockets. In a situation, where it is not desired to recover and refurbish the sensor packing, the tab maybe permanently secured in place by gluing a synthetic dowel pin thru the mated tab and socket assembly.

Referring back to FIG. 4, the bottom portion of the casing forms a rectangular cone 108 having a slightly truncated centre 112. Tabs 92 and 94 are shown partially inserted into matching sockets to join the two halves together. On two opposite sides of the truncated bottom cone are tapered slots 100 and 104 that taper outwardly from the truncated centre of the cone 112. These features are adopted to support the tether mechanism as more fully explained below.

Figure 6:
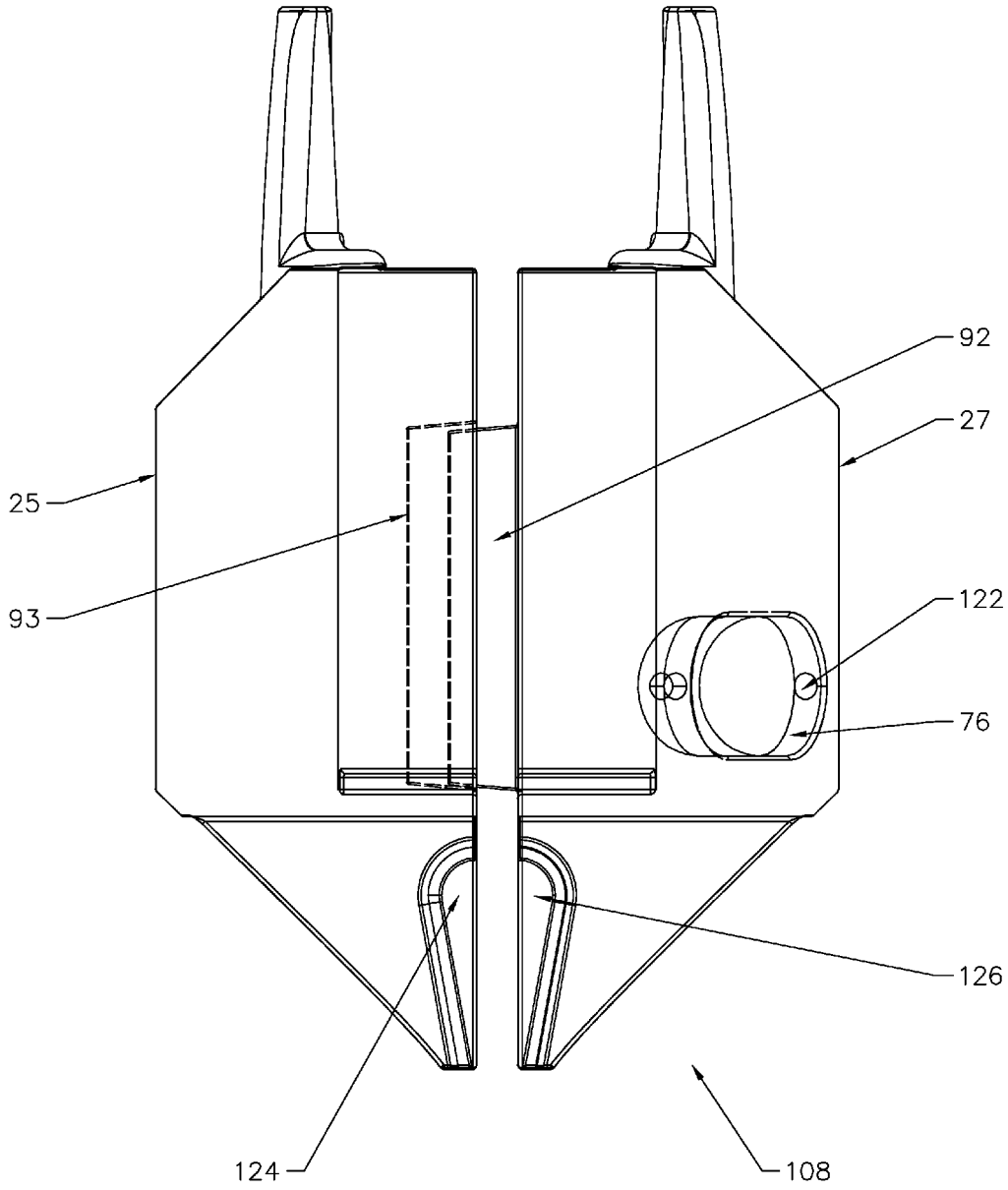
FIG. 6 is a cross-sectional side view of one embodiment of the present invention.
Figure 7:
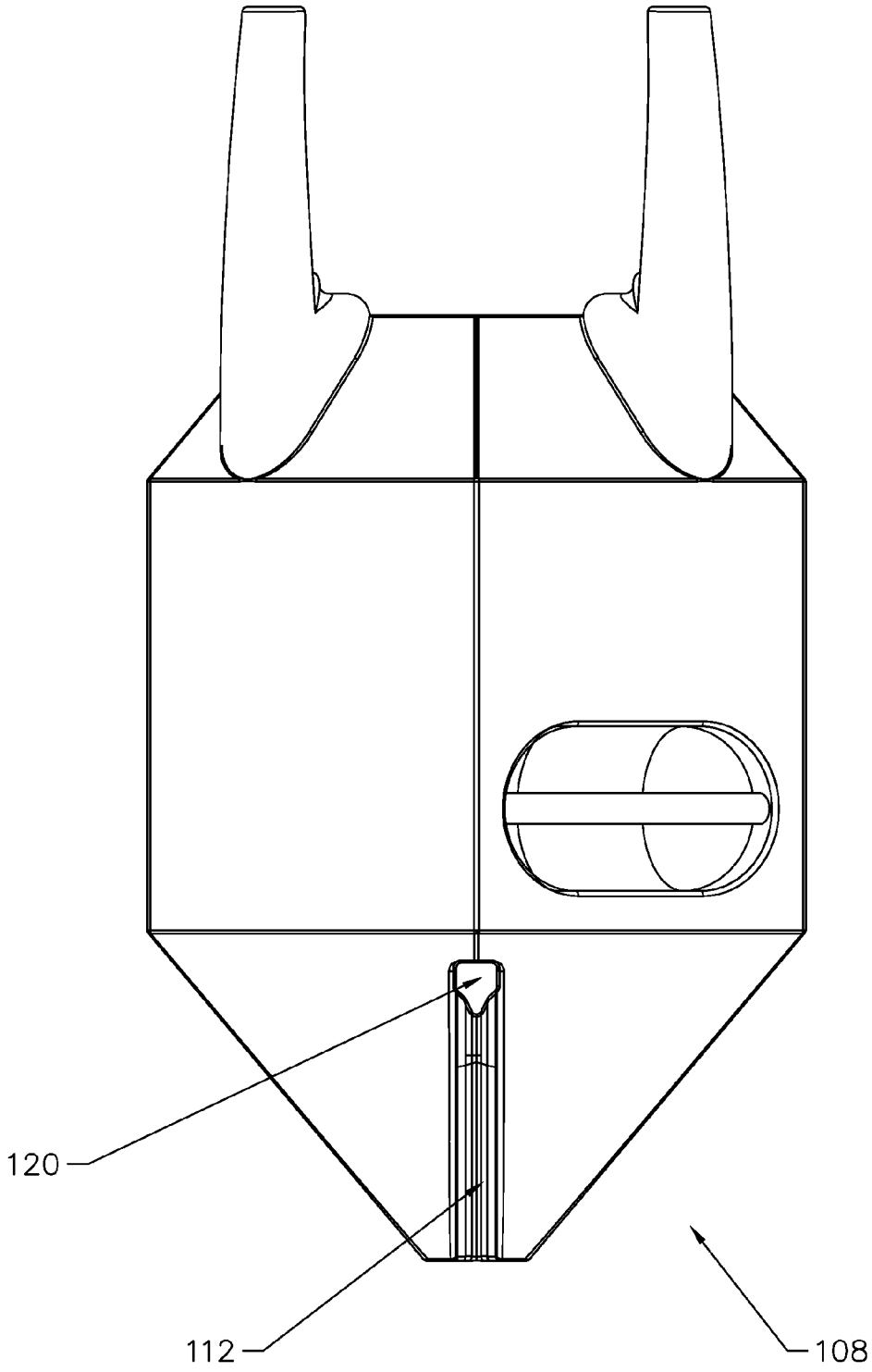
FIG. 7 is a side view of one embodiment of the present invention.

Referring to FIG. 6, there is shown a side view in cross-section of two offset halves 25 and 27, showing the tab 92 partially inserted into its mating socket 93. The indentations 74 and 76 are shown with apertures 120 and 122 adapted to receive dowels 78 and 80 as carrying handles. The bottom cone 108 is shown in cross-section illustrating the matching interior features 124 and 126 that when joined together form an internal loop of appropriate radius around which the tether is placed. FIG. 7 is a view of the area of the cone 108 slot 112 showing an orifice 120 where the tether enters the interior of the cone and is then wraps around the internal loop to exit the other side of the cone. The two half loops thus form a thimble, which is a device used to distribute the stress along the tether. This feature has the advantage of being an integral part of the positioning system, and if formed from an appropriate synthetic rope may be spliced around the internal thimble. This eliminates the need for additional fasteners and also maintains the strength of the tether; an appropriately sized thimble retains 90-100% of the strength of the original line while a knot in the tether would reduce the breaking strength to only 40-70% of the original strength, and would also present a protrusion that could hang up on fishing gear. In the present invention the casing is formed during the moulding of the shell and so no tether fasteners are required. The thimble, when combined with the slots, is able to prevent the movement of the tether in relation to the casing while suspended so as to limit kinking and chafing of the tether.

FIG. 8 illustrates the assembled casing with tether and sensor package installed. The combined weight of the casing and sensor assembly is about 45 kg. A carrying dowel installed in a recess is shown. The top projections exceed the height of the sensors in order to protect them. A tether formed of a synthetic, high strength 12-strand line is shown passed through the external groove forming part of the thimble. One end of the line has been spliced to itself forming a loop that in normal practice would be wrapped about the internal thimble.

FIG. 9 shows how the floatation collars of the present invention are stacked on the deck of a vessel making for efficient use of deck space and greater stability in sea swells.

FIG. 10 is a graph showing the great improvement, of survivability of the present invention when compared to the prior art. Fully 100% of the sensors survived using the present invention versus the prior art when placed in an area of intense bottom trawling: 2006 shows the failure over time of 11 receiver units encased in a prior art floatation collar; 2007 shows the results using the results using the present invention: and 2008 shows the results using the present invention and a heavier anchoring system that buried itself in the seabed and thus provided greater pulling force when trawls impacted the present invention. In combination with the heavier anchor all receiver units successfully survived the fishing season whereas the prior art experienced complete failure.

In operation, a plurality of sensor and casing packages are deployed to form a sensor array. The floatation collars of the present invention provide for optimal placement of the sensors in a fixed geometry vertically and horizontally relative to one another in the water column, In one application, the sensors are positioned to detect signals emitted from acoustic tags on migrating sea animals such as salmon. A series of sensors and their acoustic receivers are positioned in such a manner so that there is a high probability of signal detection whether the animal is swimming above, below or beside the receiver, the casing is tethered to an anchor which permits placement of a plurality, typically stretching across the continental shelf and partway down the continental slope to very deep water, of the sensors at any desired point in the water column to form a curtain of sensors. Since the signal emitters must have a long life they emit an infrequent and weak signal. The positioning system of this invention facilitates maximizing the probability of detection while preventing disruption by commercial fishing gear, as described below. Modern synthetic lines now exceed the breaking strength of steel cables of equivalent diameter yet float. As a result, any positioning system whose tether parts will float to the surface and may thus eventually be recovered. Because the system is modular and easy to handle on deck, a small crew can assemble and deploy between 30 and 40 positioning systems to form an array in an 8 to 10 hour period, provided that the tethers are pre-cut to the appropriate length far each sensor prior to the deployment.

Although the description above contains much specificity, these should not be construed as limiting the scope of the invention but merely providing illustrations and examples of the presently preferred embodiments of this invention.

What is claimed is:

1. A floatation collar for an undersea acoustic receiver comprising a two-piece synthetic polymer buoyant shell comprising a first half shell and a second half shell wherein each of said first half and said second half shells are filled with syntactic foam having a specific formulation for desired buoyancy and pressure resistance at a predetermined depth within a water column and further wherein each of the first half and second half shells include a half-receiving chamber so that when the first half and the second half shells are joined by joining means a receiving chamber is formed inside of the floatation collar for receiving a sensor package; and wherein, each of the first half shell and the second half shell comprise a top portion having at least four inwardly sloping flat faces a middle portion having at least four vertical flat faces and a bottom portion having at least four inwardly sloping flat faces for sonar detection and so that when the first half shell and the second half shell are joined the floatation collar has a square or hexagonal shape to facilitate both detection by sonar when deployed in the water and a compact and stable packing of a plurality of receivers while being transported on a deck of a boat.

2. The floatation collar of claim 1 wherein the first half shell and the second half shell further comprise two acoustically transparent vertical projections having a curved indentation and extending from two of said top portions at least four inwardly sloping flat faces for protecting said sensor package against mechanical damage.

3. The floatation collar of claim 2 wherein the top portion and said bottom portion at least four inwardly sloping faces have a slope angle of 45 degrees for sonar reflectivity from surface and sub-surface vessels respectively.

4. The flotation collar of claim 3 wherein the bottom portion includes an anchoring tether rope connector comprising a tether thimble around which an anchoring tether rope is attached to the floatation collar by a non-metallic splice and wherein said tether thimble distributes stress along said splice so that said non-metallic splice retains 90% to 100% of original anchoring tether rope strength.

5. The floatation collar of claim 4 wherein the bottom of the floatation collar forms a rectangular or hexagonal cone-shaped projection tapered at 45 degrees for anti-fouling so that when floatation collar is anchored at an operating depth and the anchoring tether rope is snared by a moving object the floatation collar will descend to a depth of said moving object and slide underneath the moving object without capture and then return to said operating depth, maintaining the optimal geometry for the acoustic receiver.

* * * * *